United States Patent [19]

Hawkins

[11] 4,332,976

[45] Jun. 1, 1982

[54] COAXIAL CABLES

[75] Inventor: Richard E. Hawkins, Colchester, Vt.

[73] Assignee: Champiain Cable Corporation, Wilmington, Del.

[21] Appl. No.: 156,546

[22] Filed: Jun. 5, 1980

[51] Int. Cl.[3] ..... H01B 7/18

[52] U.S. Cl. ..... 174/107; 174/29; 174/36; 174/102 R; 174/111; 174/121 SR; 174/120 SR

[58] Field of Search ..... 174/29, 36, 102 R, 110 F, 174/111, 113 AS, 120 SR, 121 SR, 107; 428/383, 473.5, 477.7; 156/56

[56] References Cited

U.S. PATENT DOCUMENTS

| | | | |
|---|---|---|---|
| 2,585,484 | 2/1952 | Denes | 174/29 X |
| 3,309,458 | 3/1967 | Yoshimura . | |
| 3,573,976 | 4/1971 | Duane . | |
| 3,681,515 | 8/1972 | Mildner | 174/2 |
| 3,968,463 | 7/1976 | Boysen . | |
| 4,107,354 | 8/1978 | Wilkenloh . | |
| 4,161,564 | 7/1979 | Legbandt | 428/383 |

*Primary Examiner*—Elliot A. Goldberg
*Attorney, Agent, or Firm*—Michael B. Keehan

[57] ABSTRACT

A dielectric system for coaxial electrical conductors is provided. The dielectric system separates an inner and outer conductor and is composed of a first layer of braided high tensile strength polymeric fluorocarbon filaments in an open weave surrounding the inner conductor. Surrounding the layer of braided filaments is a layer of cellular polyparabanic acid tape which is helically wound along the length of the cable with a negative overlap. Circumferentially surrounding these two layers along the length of the cable is a continuous layer of polymeric film which is in turn surrounded by a continuous layer of a crosslinkable polymeric lacquer.

7 Claims, 1 Drawing Figure

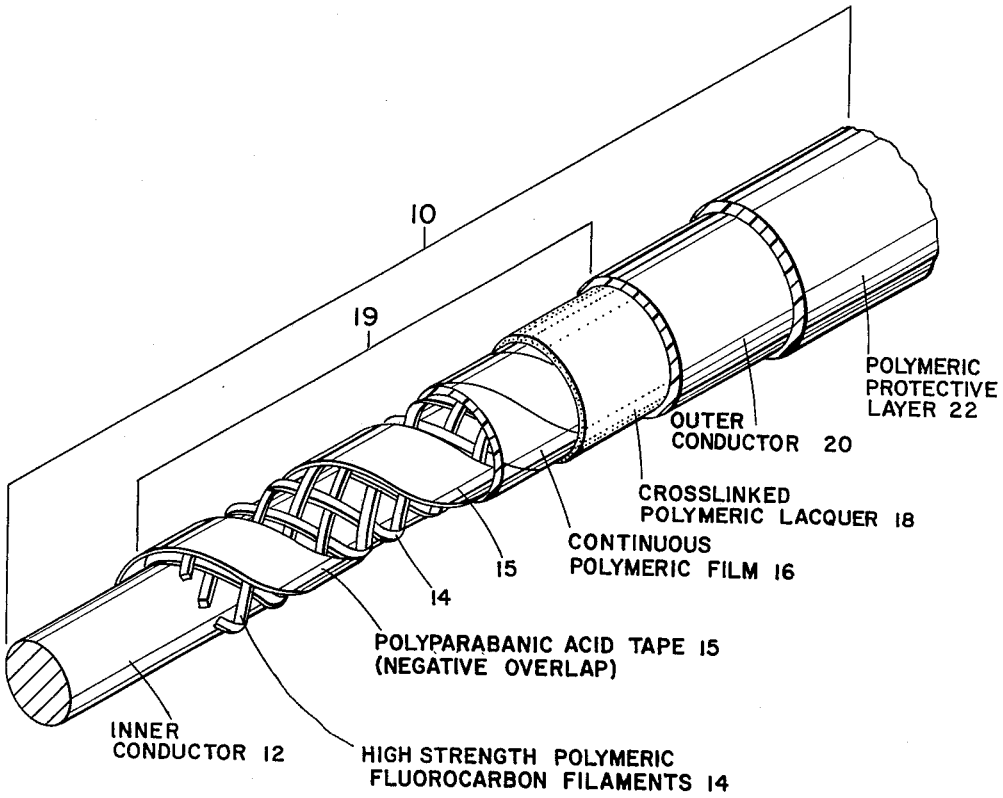
10
19
POLYMERIC PROTECTIVE LAYER 22
OUTER CONDUCTOR 20
CROSSLINKED POLYMERIC LACQUER 18
CONTINUOUS POLYMERIC FILM 16
15
14
POLYPARABANIC ACID TAPE 15 (NEGATIVE OVERLAP)
INNER CONDUCTOR 12
HIGH STRENGTH POLYMERIC FLUOROCARBON FILAMENTS 14

COAXIAL CABLES

SUMMARY OF THE INVENTION

The present invention relates to a dielectric system for use in a coaxial cable. In particular, the present invention relates to a dielectric system for coaxial electrical conductors which separates an inner and an outer conductive material and which comprises a first layer of braided high tensile strength polymeric fluorocarbon filaments in an open weave surrounding an inner conductor along its length, a second layer overlying the braided filament layer consisting of a layer of cellular polyparabanic acid tape which is helically wound along the length of the cable with a negative overlap. Circumferentially surrounding these two layers along the length of the cable is a continuous skin of polymeric film, and a fourth layer overlying the continuous polymeric film layer consisting of a continuous skin of a crosslinkable polymeric lacquer.

BACKGROUND OF THE INVENTION

A coaxial cable is usually comprised of an inner conductive member, a dielectric system surrounding the inner conductor, and an outer conductive member coaxially surrounding the dielectric system. The inner conductive member and the outer conductive members are made with some appropriate metal, most commonly copper, aluminum or some alloy containing such metal. The dielectric system is usually composed of some suitable plastic, and use of polyethylene, polystyrene, and polypropylene, in expanded or unexpanded form, is common.

The best dielectric, from a theoretical standpoint, would be a layer of air, which has a dielectric constant of 1.0. It is virtually impossible to construct such a cable, however, and commercial cables employ solid materials with necessarily higher dielectric constants. The higher the dielectric constant of the material, the lower the velocity of propagation of the coaxial cable as a whole, and thus, the longer the cable will take to transmit an electrical signal along its length. In addition to improved velocity of propagation, a lower dielectric constant will allow a thinner insulation layer which should produce a smaller finished cable diameter. This becomes important in applications which have space or weight limitations.

One method which has been followed in attempting to increase the velocity of propagation of a cable has been to decrease the effective dielectric constant by introducing air or other materials into an otherwise solid dielectric layer.

In U.S. Pat. No. 3,309,458, a coaxial conductor is shown which employs as a dielectric a two-layer system. The first layer of the system is comprised of a brittle foamed synthetic resin and the second layer is composed of a nonfoamed synthetic resin which is pliable in comparison with the foamed resin.

In U.S. Pat. No. 3,573,976, a coaxial cable is provided in which the dielectric is extruded from a combination of glass, silica or ceramic microspheres; a suspension of powdered polyethylene or polymeric fluorocarbon resin; a volatile ethylene dichloride or trichloroethylene carrier and a tackifying agent of polyisobutylene or hexafluoropropylenevinylidene fluoride copolymer. The microspheres, or microballoons as they are also known, are discrete, hollow, spherical particles, and the effective dielectric constant of the dielectric system is reduced according to the amount of air encapsulated therein.

U.S. Pat. No. 3,968,463 discloses a coaxial cable having as a dielectric coating on the core conductor, an extruded cellular ethylene or propylene polymer based composition.

U.S. Pat. No. 4,107,354 is directed to a method of forming a coaxial cable by coating a center conductor of the cable with a dielectric composed of cellular polyolefin.

The problem which has been encountered with coaxial cables employing foamed dielectric systems is that as the amount of foaming, and therefore the amount of encapsulated air, is increased, the mechanical and heat resistance properties of the cable are adversely affected. To provide sufficient mechanical strength, cables must have diminished flexibility or increased size, and this limits the applications for which the cable may be used.

Another method used to incorporate air into the dielectric system has been through the use of disk type insulating separators. Following this method, disk type insulating separators of a material such as polyethylene are fitted onto an inner conductor at spaced intervals, thereby leaving air filled interstitial spaces. Such construction, however, lacks mechanical strength, particularly when the coaxial cable is bent, and the cables must be handled with great care.

It is an object of the present invention to provide a dielectric system for a coaxial cable which has a low effective dielectric constant.

It is a further object of the present invention to provide a dielectric system for a coaxial cable which has a low effective dielectric constant, but which has sufficient mechanical strength to allow substantial flexibility in the finished cable.

It is still a further object of the present invention to provide a dielectric system for a coaxial cable which has a low effective dielectric constant, but which has sufficient mechanical strength over a substantial range of temperatures to allow the construction of cables of very small diameter with consistent and predictable electrical characteristics, which are particularly useful in applications which call for miniaturized electrical conductors.

The foregoing, as well as other objects, features, and advantages of the present invention are pointed out with particularity in the claims annexed to this specification. Further, they will become more apparent in light of the following detailed description of the preferred embodiment thereof and as illustrated in the accompanying drawings.

According to the present invention, there is provided a dielectric system for coaxial electrical conductors which separates an inner and outer conductive material. The dielectric system of the present invention comprises a first layer of braided high tensile strength polymeric fluorocarbon filaments in an open weave surrounding an inner conductor along its length. This layer of braided filaments is in turn covered by a second layer consisting of cellular polyparabanic acid tape which is helically wound along the length of the cable with a negative overlap. Circumferentially surrounding these two layers along the length of the cable is a third layer consisting of polymeric film, which provides a continuous skin over the cellular polyparabanic acid layer. A fourth layer, consisting of a crosslinkable polymeric lacquer, surrounds the third layer and provides a continuous skin enclosing the dielectric system circumferentially.

BRIEF DESCRIPTION OF THE DRAWING

The drawing shows a segment of a coaxial cable with the dielectric system of the present invention, having the various layers cut away for the purposes of illustration.

DETAILED DESCRIPTION OF THE PREFERRED EMBODIMENT

A typical coaxial conductor employing the dielectric system (19) of the present invention is shown in the drawing. The coaxial cable (10) has been cut away to show its various layers. An inner metallic conductor (12), sometimes referred to as a core, is shown as the central element, and is surrounded circumferentially by the dielectric system (19) of the present invention. This conductor may be constructed of copper or aluminum or some appropriate alloy, and may be in the form of a solid wire or a plurality of individual metallic strands wound together.

This inner conductor (12) is surrounded by a first layer of braided high tensile strength polymeric fluorocarbon filaments which create an open weave (14) about the said inner conductor (12). These filaments should have a tensile strength of at least 40,000 p.s.i., preferably in the range of 45,000 to 55,000 p.s.i., and they should have a dielectric constant of less than 2.8. A layer of cellular polyparabanic acid tape (15) is helically wound along the length of the cable with a negative overlap, so as to leave spaces of 30 to 60% of the tape width along the cable. The tape helps to encapsulate air in the open weave of the braided filament layer (14), as well as within the cells of the tape (15) and the spaces left by the negative overwrap. A continuous layer (16) composed of polyimide, polyparabanic acid, polyester or any similar thin, high tensile strength film which remains stable at temperatures up to 150° C., is next employed and provides a continuous skin circumferentially surrounding the layer of braided filament (14) and the helically wound cellular polyparabanic acid (15). It is advantageous to apply this layer in a solid form so that material does not infiltrate the interstices created by the braided layer (14) and the negative overlap of the cellular polyparabanic acid layer (15) in the place of the desired air. For this reason, the present invention contemplates the application of the material for this layer in the form of a continuous tape wrapped around the cellular polyparabanic acid layer (15) and the braided layer (14) by means well known to the art. However, the present invention is not meant to be limited to the application of this layer (16) by this means.

A continuous layer of crosslinkable polymeric lacquer (18) surrounds the polymeric film layer (16) and acts both as an adhesive, holding the inner layers in place, and as a sealant. This layer (18) represents the outermost layer of the dielectric system (19) of the present invention and may be applied by a dip coating technique or by other means known to the art.

To complete the cable, an outer conductor (20), which may be woven or solid, is disposed circumferentially about the dielectric system (19) of the present invention and said outer conductor (20) is typically surrounded circumferentially by a compatible protective layer (22) of a type well known to the art.

EXAMPLE 1

A small diameter coaxial cable for use in an application requiring miniature coaxial cable was fabricated with the dielectric system of the present invention in the following manner. A 30 AWG solid copper conductor with a 0.010 inch diameter was used as a central conductive member. Eight 0.006 inch filaments of ethylene-chlorotrifluoroethylene copolymer, available commercially from Allied Chemical under the Trademark Halar® were braided over said central conductor on a Wardwell Braiding Machine Company sixteen carrier braider to a density of 12 to 15 picks per inch.

Over the open weave braid thus produced, a layer of cellular polyparabanic acid, commercially available from Exxon under the Trademark Tradlon® was applied. The polyparabanic acid was applied in the form of a tape, 0.006 inch in thickness and 0.062 inch in width, on an EJR Engineering tape-wrapping machine which is capable of providing accurate tension control. The tape was applied with a negative overlap, in order to leave a space of 50% of the tape width.

Over this assembly, a continuous layer of non-cellular polyparabanic acid, available under the same Trademark, was applied. This layer was applied in the form of thin tape, measuring 0.001 inch in thickness and 0.187 inch in width, on an EJR Engineering tape-wrapping machine which is capable of providing accurate tension control. This tape was applied with a sufficient overlap, about 20–25%, to avoid separation when the cable is bent, while still maintaining a small diameter in the dielectric system.

Over the continuous polyparabanic acid layer, an acrylic topcoat layer was applied which acts as an adhesive and sealant. In this example, a thin coating of liquid methyl methacrylate containing a self-contained crosslinking agent, commercially available from the Rohm and Haas Company under the Trademark Rhoplex AC-1230®, was applied using a dip flow coating technique known to the art, and cured in a wire enameling oven. An outer conductive member and an polymeric fluorocarbon protective layer were applied in a manner well known to the art.

The resulting cable demonstrated the following useful properties, which did not deteriorate with substantial handling or flexing and exposure to a wide temperature range.

Electrical
- Characteristic Impedance: 75 ohms
- Capacitance: 16–17 picofarads per foot
- Velocity of Propagation: 81–83% (of the speed of light)

Other
- Finished cable diameter: less than or equal to 0.075 inch
- Maximum continuous operating temperature: approximately 150° C.
- Flexibility and mechanical strength: very good
- Solder bath test (230° C.–15 sec.): no effect

EXAMPLE 2

A small diameter coaxial cable was fabricated according to the method described in Example 1. A 32 AWG central conductive member having a diameter of 0.008 inch was braided over to a braid density of 10 to 15 picks per inch with eight 0.008 inch diameter filaments of ethylene-chlorotrifluoroethylene copolymer. A layer of cellular polyparabanic acid of the same type described in Example 1 was applied helically over the open weave of the braided layer following the teachings of Example 1. The tape, which measured 0.006 inch in thickness and 0.062 inch in width, was applied with a negative overlap, leaving space along the length of the cable of 50% of the width of the tape. A continuous layer of polyparabanic acid was then applied over the resulting open structure, following the teachings of Example 1, and using a polyparabanic acid tape 0.001 inch in thickness and 0.187 inch in width in such a manner so as to produce a 20–25 percent overlap. An acrylic topcoat layer of the same material used in Example 1 was applied in the same manner as described therein. Following this, an outer conductive member and a polymeric fluorocarbon protective layer were applied in a manner well known to the art.

The resulting cable demonstrated the following useful properties, which did not deteriorate with substantial handling or flexing and exposure to a wide temperature range.

Electrical
Characteristic Impedance: 90 ohms
Capacitance: approximately 14 picofarads per foot
Velocity of Propagation: 80–82% (of the speed of light)
Other
Finished cable diameter: less than 0.70 inch
Maximum continuous operating temperature: approximately 150° C.
Flexibility and mechanical strength: very good
Solder bath test (230° C.–15 sec.): No effect.

EXAMPLE 3

A small diameter coaxial cable was fabricated according to the method described in Example 1. A 30 AWG solid copper central conductive member having a 0.010 inch diameter was braided over to a braid density of 10–15 picks per inch with eight 0.009 inch diameter filaments of ethylene-chlorotrifluoroethylene copolymer. A layer of cellular polyparabanic acid of the same type described in Example 1 was applied helically over the open weave of the braided layer following the teachings of Example 1. The tape, which measured 0.006 inch in thickness and 0.091 inch in width, was applied with a negative overlap, leaving space along the length of the cable of 50% of the width of the tape. A continuous layer of polyparabanic acid was then applied over the resulting structure following the teachings of Example 1, using a polyparabanic acid tape 0.001 inch in thickness and 0.187 inch in width in such a manner so as to produce a 20–25 percent overlap. An acrylic topcoat layer of the same material used in Example 1 was applied in the same manner as described therein. Following this, an outer conductive member and a protective layer were applied in a manner well known to the art.

The resulting cable had a characteristic impedance of 100 ohms and demonstrated useful dielectric properties.

What I claim and desire to protect by Letters Patent is:

1. A coaxial cable comprising:
(a) an inner conductor;
(b) a dielectric system comprising:
(i) a first layer of braided high tensile strength polymeric fluorocarbon filaments surrounding said inner conductor in an open weave along the length of the inner conductor;
(ii) a second layer of cellular polyparabanic acid tape surrounding circumferentially said first layer, said second layer being helically wound with a negative overlap along the length of the inner conductor so as to leave spaces between wraps of said tape about said first layer;
(iii) a third layer circumferentially surrounding said second layer, said third layer comprising a high strength polymeric film that remains stable at temperatures up to 150° C. providing a continuous skin enclosing said first and second layers; and
(iv) a fourth layer surrounding the third layer of polymeric film, said fourth layer comprising a crosslinked polymeric lacquer;
(c) an outer conductor being disposed coaxially and circumferentially about the dielectric system; and
(d) an outer protective layer surrounding circumferentially said outer conductor.

2. A coaxial cable of claim 1 in which the negative overlap of said second layer leaves spaces of 30% to 60% of the width of said cellular polyparabanic acid tape along the length of the inner conductor.

3. A coaxial cable of claim 1 or 2 in which the third layer comprises a high strength polymeric film which remains stable at temperatures of up to 150° C.

4. A coaxial cable of claim 1 or 2 in which the third layer of polymeric film is polyparabanic acid film.

5. A coaxial cable of claim 1 or 2 in which the third layer is a polyimide film.

6. A coaxial cable of claim 1 or 2 in which the third layer is polyester film.

7. A coaxial cable of claim 1 or 2 in which the high strength polymeric fluorocarbon filaments have a tensile strength of at least 40,000 psi and a dielectric constant of less than 2.8.

* * * * *

UNITED STATES PATENT AND TRADEMARK OFFICE

CERTIFICATE OF CORRECTION

PATENT NO. : 4,332,976

DATED : June 1, 1982

INVENTOR(S) : Richard E. Hawkins

It is certified that error appears in the above-identified patent and that said Letters Patent is hereby corrected as shown below:

On the title page, Item /73/ "Champiain: should read -- Champlain --.

Signed and Sealed this

*Fourteenth* Day of *June 1983*

[SEAL]

*Attest:*

DONALD J. QUIGG

*Attesting Officer*

*Acting Commissioner of Patents and Trademarks*